United States Patent [19]

Mendoza

[11] Patent Number: 4,901,937

[45] Date of Patent: Feb. 20, 1990

[54] CABLE REEL BEARER AND DOLLY

[76] Inventor: Lamec E. Mendoza, 2654 N. Frederic St., Burbank, Calif. 91504

[21] Appl. No.: 208,753

[22] Filed: Jun. 20, 1988

[51] Int. Cl.[4] ..... B65H 17/40; B65H 17/46

[52] U.S. Cl. ..... 242/86.5 R; 242/86.7; 242/129.62

[58] Field of Search ..... 242/86.5 R, 86.7, 99, 242/129, 129.62, 86, 86.2, 129.5, 129.8

[56] References Cited

U.S. PATENT DOCUMENTS

| | | | |
|---|---|---|---|
| 2,310,036 | 2/1943 | Owens | 242/86.5 R |
| 3,072,356 | 1/1963 | Leuthner | 242/129.6 |
| 3,128,962 | 4/1964 | Bieber | 242/86.5 |
| 4,190,211 | 2/1980 | Janzen | 242/99 X |
| 4,325,224 | 4/1982 | Sauber | 242/86.7 |
| 4,564,152 | 1/1986 | Herriage | 242/86.5 R |
| 4,585,130 | 4/1986 | Brennan | 242/129.6 |
| 4,721,833 | 1/1988 | Dubay | 242/85 X |
| 4,746,078 | 5/1988 | Setzke | 242/129.6 X |

*Primary Examiner*—Joseph J. Hail, III
*Assistant Examiner*—Steven M. duBois

[57] ABSTRACT

An improved cable reel bearer comprising a base, a frame pivotally mounted on the base and extending vertically upward from the base, at least one crossarm mounted on the frame and extending perpendicular to the frame to receiv and support cable reels mounted on the crossarm, a resilient brake carried by the crossarm to prevent undesired rotation of cable reels mounted on the crossarm, rotation pad means mountable on the crossarm between a pair of adjacent cable reels to permit free and independent rotation of either of the adjacent reels, and a dolly releaseably engageable with the frame to facilitate transportation of the reel bearer from one location to another.

11 Claims, 4 Drawing Sheets

CABLE REEL BEARER AND DOLLY

BACKGROUND

1. FIELD OF INVENTION

This invention relates to electrical cable and is particularly directed to a cable reel bearer for supporting one or more reels of cable together with a dolly for transporting the bearer and cable reels carried thereby.

2. PRIOR ART

In wiring residential and commercial buildings, motion picture sets and the like, it is often necessary for an electrician to employ several different colors, sizes or types of cable or to run several lines using independent reels of a common type of cable. In these instances, the electrician must carry several reels of cable, which may each weigh ten to twenty pounds, and be able to run each cable line to a desired location without confusion or interference with the other cable lines. Obviously, considerable effort is required to move these cable reels from room to room and to maneuver the reels to permit feeding the cables to desired locations within a room without tangling with other cables. Numerous devices have been proposed heretofore to overcome these problems. However, none of the prior art cable reel bearers have been entirely satisfactory.

A search in the U.S. Pat. Office has revealed the following prior art:

| U.S. Pat. No. | INVENTOR | ISSUE DATE |
|---|---|---|
| 4,457,527 | A. J. Lowery | Jul. 3, 1984 |
| 4,564,152 | A. A. Herriage | Jan. 14, 1986 |
| 4,579,358 | B. Byfield, Jr. | Apr. 1, 1986 |
| 4,611,645 | D. H. Whisnant | Sep. 16, 1986 |

The patents to Lowery and Heritage each disclose cable reel bearers which are relatively bulky and complex and, hence, would be relatively expensive to produce and complicated to use. The patents to Byfield and Whisnant teach cable reel bearers which are relatively simple in construction. However, all of the prior art cable bearers are relatively cumbersome to rotate so as to facilitate running cables to different sides of a room without tangling with other cables. Furthermore, Byfield and Whisnant merely provide studs for mounting the cable reels. Consequently, when cable is drawn off of the reels, the reels tend to continue to rotate, after the desired length of cable has been drawn off, allowing additional cable to unreel onto the floor and creating additional work for the electrician. Lowery and Herriage each provide brake means for preventing such spillage, however, their brake means are complicated to use and complex to produce.

BRIEF SUMMARY AND OBJECTS OF INVENTION

These disadvantages of the prior art are overcome with the present invention and an improved cable reel bearer and dolly are provided which is compact and simple to produce, maintain and use, yet provides great freedom of movement for the electrician without tangling or spilling of the cables.

These advantages of the present invention are preferably attained by providing a cable reel bearer comprising a base, a frame pivotally mounted on said base and extending vertically upward from said base, at least one cross arm mounted on said frame and extending perpendicular to said frame to receive and support cable reels mounted on said cross arm, resilient brake means carried by said cross arm to prevent undesired rotation of cable reels mounted on said cross arm, rotation pad means mountable on said cross arm between a pair of adjacent cable reels to permit free and independent rotation of either of said adjacent reels, and a dolly releaseably engageable with said frame to facilitate transportation of said reel bearer from one location to another.

Accordingly, it is an object of the present invention to provide an improved reel bearer.

Another object of the present invention is to provide an improved reel bearer which provides freedom for an electrician to work on various sides of a room without tangling the cables carried by the reel bearer.

A further object of the present invention is to provide a cable reel bearer and dolly which is simple to construct maintain and use.

A specific object of the present invention is to provide an improved cable reel bearer comprising a base, a frame pivotally mounted on said base and extending vertically upward from said base, at least one crossarm mounted on said frame and extending perpendicular to said frame to receive and support cable reels mounted on said crossarm, resilient brake means cried by said crossarm to prevent undesired rotation of cable reels mounted on said crossarm, rotation pad means mountable on said crossarm between a pair of adjacent cable reels to permit free and independent rotation of either of said adjacent reels, and a dolly releaseably engageable with said frame to facilitate transportation of said reel bearer from one location to another.

These and other objects and features of the present invention will be apparent from the following detailed description, taken with reference to the figures of the accompanying drawing.

DETAILED DESCRIPTION OF THE INVENTION

Figure 1:
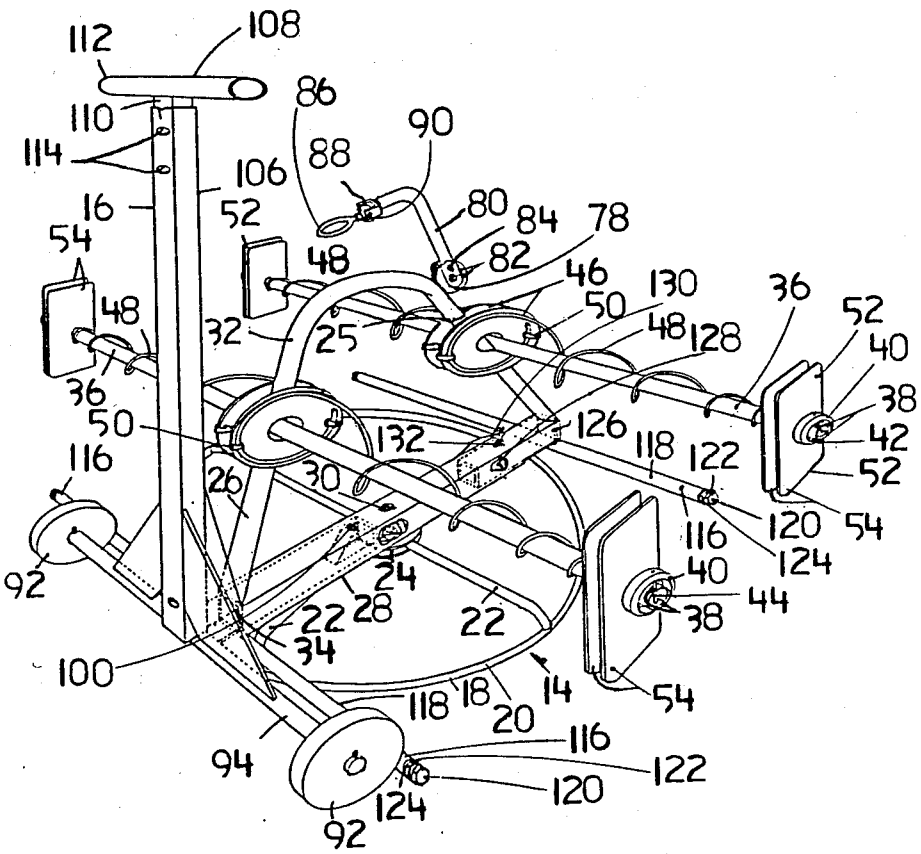
FIG. 1 is an isometric view of a cable reel bearer and dolly assembly embodying the present invention.
Figure 2:
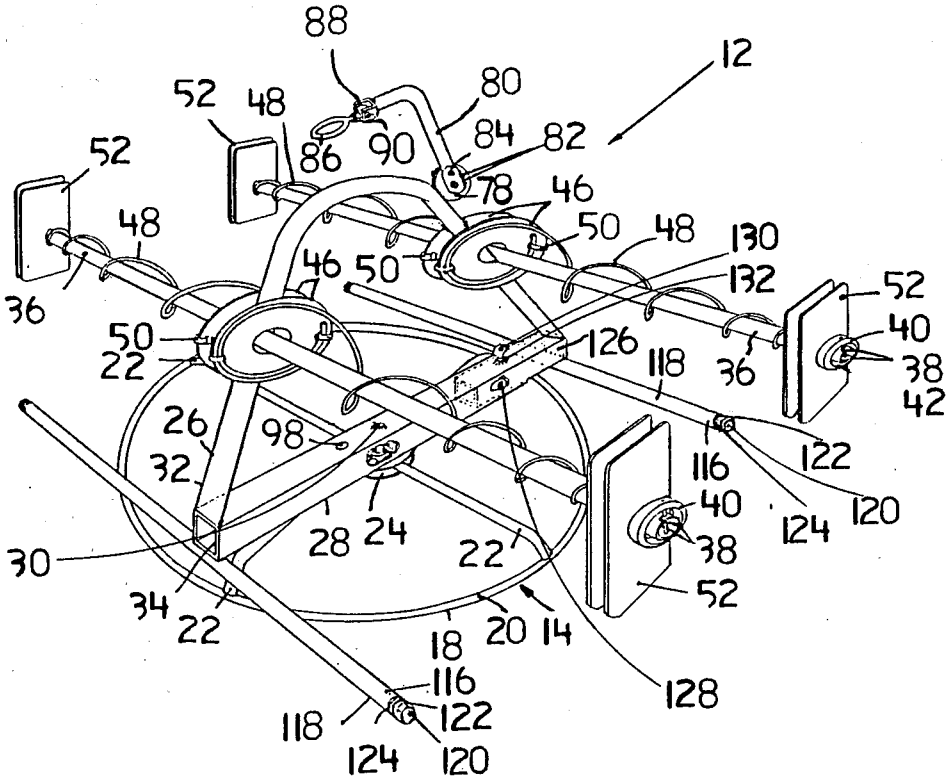
FIG. 2 is a view, similar to that of FIG. 1, showing the cable reel bearer of the assembly of FIG. 1 with the dolly removed.
Figure 12:
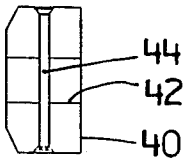
FIG. 12 is a transverse section through the crossarm end piece of FIG. 10 taken on the line 12—12 thereof.
Figure 11:
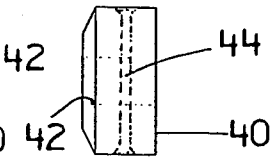
FIG. 11 is a side view of the crossarm end piece of FIG. 10.
Figure 7:
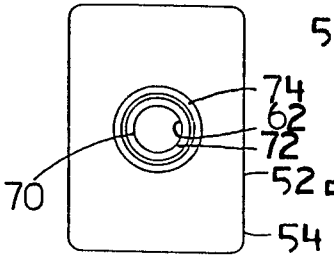
FIG. 7 is an end view of the rotation pad of FIG. 6.
Figure 10:
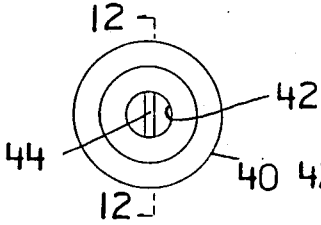
FIG. 10 is an end view of one of the crossarm end pieces of the reel bearer of FIG. 1.

In that form of the present invention chosen for purposes of illustration in the drawings, FIG. 1 shows a cable reel bearer assembly, indicated generally at 12, comprising a reel bearer 14 and a dolly 16. As best seen in FIG. 2, the reel bearer 14 comprises a base 18 formed by a ring 20 having four legs 22 extending upwardly and inwardly from the ring 20 to support a central hub 24. A frame 26 has a horizontal channel member 28 pivotally mounted on the hub 24 of the base 18, as by bolt 30 and has an arcuate member 32 projecting vertically upward from the horizontal channel member 28. Preferably, the channel member 28 will be rectangular in cross-section and open-ended, as seen at 34, while the vertical arcuate member 32 is preferably of rounded cross-section. One or more crossarms 36 are mounted, in spaced relation, on the arcuate member 32 and project perpendicularly outward therefrom. The crossarms 36 are sized to fit through the central openings of standard cable reels, not shown, and have generally L-shaped recesses 38 formed in the ends of the crossarms 36 to receive and releaseably retain end pieces 40 for retaining cable reels mounted on the crossarms 36. As best seen in FIGS. 10–12, the crossarm end pieces 40 are annular members formed with a central opening 42, to permit mounting the end pieces 40 on the ends of the crossarms 36, and are provided with a bar 44 extending transversely across the opening 42 for engagement with the L-shaped recesses 38 to releaseably retain the end pieces 40 mounted on the ends of the crossarms 36, A pair of flanges 46 are mounted on each of the crossarms 36 and are located on opposite sides of and are secured to the arcuate member 32 of the frame 26, as seen in FIGS. 1 and 2, and resilient brake means, such as helical spring wires 48, each have one end 50 thereof secured to a respective one of the flanges 46 and extend outwardly therefrom along the crossarms 36 and winding about the crossarms 36. When a cable reel is mounted on the crossarm 36, the resilient brake means 48 bears against the reel and causes the reel to frictionally bear against the end piece 40. When the electrical draws cable off of the reel, the reel spins on the crossarm 36 to release the cable. However, when the electrician ceases drawing the cable, the friction between the resilient brake means 48, the reel and the end piece 40 halts spinning of the reel and prevents the cable from spilling.

Figure 8:
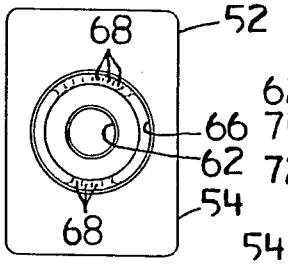
FIG. 8 is a vertical section through the rotation pad of FIG. 6 taken on the line 8—8 thereof.
Figure 6:
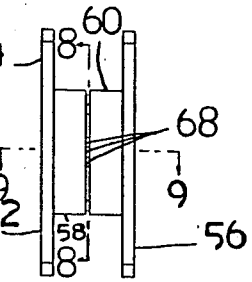
FIG. 6 is a side view of one of the rotation pads of the reel bearer of FIG. 1.

If desired, one or more rotation plates 52 may be mounted on the crossarm 36 between the cable reel and the end piece 40 or , where between adjacent cable reels, where more than one reel is mounted on a given part of one of the crossarms 36. As best seen in FIGS. 6–9, the rotation plates 52 each comprise a pair of side plates 54 and 56 formed with central bosses 58 and 60 which project toward each other and have bores 62 and 64 extending axially therethrough. Each of the bosses 58 and 60 is formed with an annular raceway 66 concentric with the bore 62 or 64 and a plurality of ball bearings 68 are positioned between the side plates 54 and 56, as seen in FIGS. 6 and 8. The side plates 54 and 56 are secured together by suitable means, such as bushing 70 which extends through the bores 62 and 64 and has its ends 72 flared outwardly within recesses 74 and 76 on the outer faces of the side plates 54 and 56. In this way, the ends 72 of the bushing 70 do not engage adjacent objects, such as reels or the end pieces 40.

Because of the ball bearings 68, each of the side plates 54 and 56 is able to rotate freely independent of the adjacent side plate 54 or 56. Thus, where only one cable reel is mounted on a crossarm 36, the rotation plate 52 should be located between the reel and the end piece 40 of that crossarm 36. Thus, the resilient brake means 48 will bear against the cable reel to urge the cable reel outwardly against the rotation plate 52 to prevent unwanted rotation, while the rotation plate 52 will prevent any tendency for the reel to bind against the end piece 40. Where more than one cable reel is mounted on a given one of the crossarms 36, the rotation plates 52 will be mounted between adjacent cable reels. In this way, the resilient brake means 48 will urge all of the cable reels, together with the intermediate rotation plates 52 outwardly, causing the outer side of the outer cable reel to bear against the end piece, while inner cable reels are urged against the outwardly adjacent rotation plate 52. With this arrangement, the rotation plates 52 will permit free rotation of either of the adjacent cable reels for withdrawing of cable therefrom, whereas the outward urging of the resilient braking means 48 will prevent unwanted rotation which could result in spillage of the cables.

Adjacent the top of the arcuate member 32 of the frame 26 is mounted a vertically projecting bracket 78 and a cabling arm 80 is pivotally mounted On the bracket 78, as seen in FIGS. 1 and 2. Adjustment means, such as holes 82, are provided in the bracket to permit selective vertical positioning of the cabling arm 80 and suitable means, such as removable pin 84 are provided to permit securing the cabling arm 80 in a desired vertical position. At the opposite end of the cabling arm 80, a cabling ring 86 is mounted for rotational adjustment, as by a U-shaped bracket 88 pivotally secured to the end of the cabling arm 80 which is securable in a desired rotational position by suitable means, such as clamp 90. Where the electrician finds it necessary to run a plurality of cables simultaneously from several reels mounted on the reel bearer 14, the cables may be threaded through the cabling ring 86 to enable the plurality of cables to be handled more or less as a single entity, and the positions of the cabling arm 80 and cabling ring 86 may be adjusted, as desired, to facilitate such handling.

Figures 3, 4, 5:
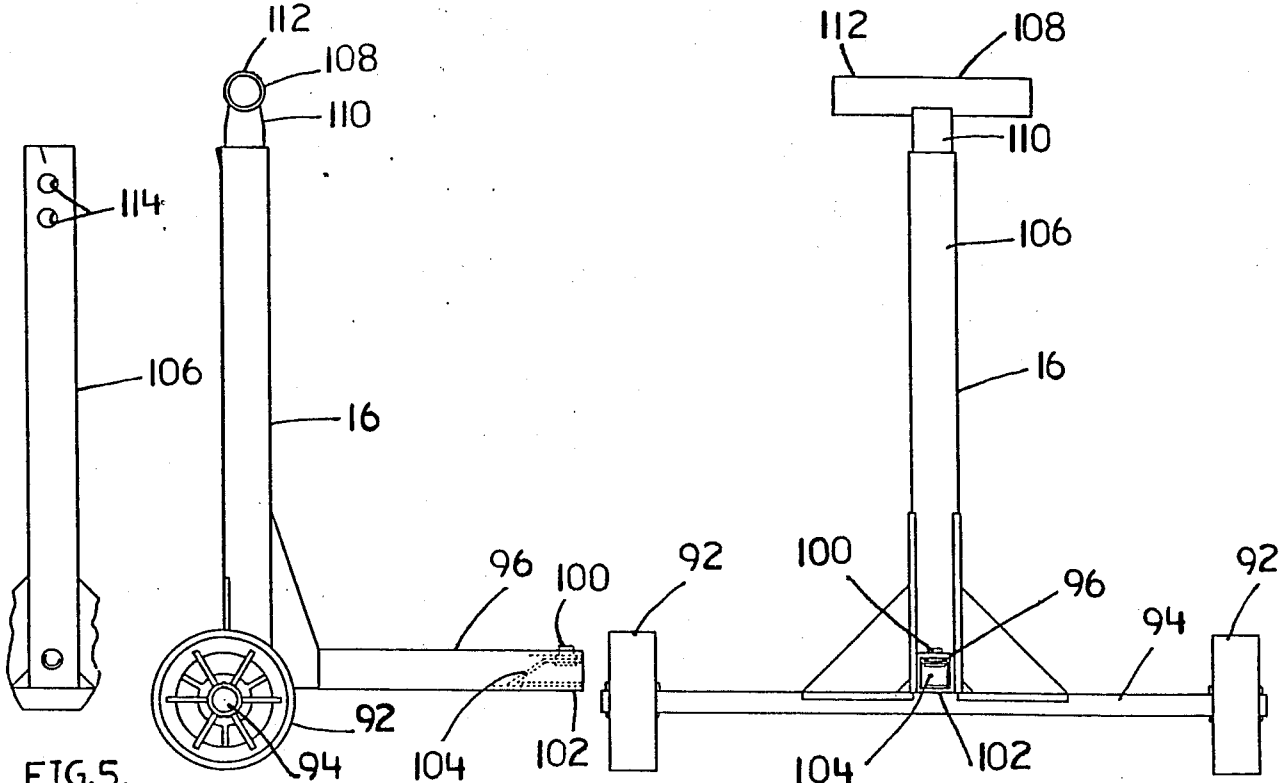
FIG. 3 is a side view of the dolly of the assembly of FIG. 1 removed from said assembly.
FIG. 4 is a front view of the dolly of FIG. 3.
FIG. 5 is a rear view of the handle of the dolly of FIG. 3.
Figure 9:
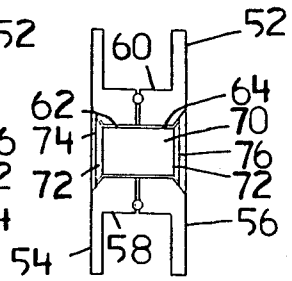
FIG. 9 is a horizontal section through the rotation pad of FIG. 6 taken on the line 9—9 thereof.

To move the reel bearer 14 from one location to another, a dolly 16 is provided, as best seen in FIGS. 1, 3, 4 nd 5. The dolly 16 comprises a pair of wheels 92 mounted on opposite ends of an axle 94 and a hollow shaft 96 which projects forwardly from the axle 94 and is formed to slide telescopically into the open end 34 of the channel member 28 of frame 26 of the reel bearer 14. The channel member 28 is preferably formed with a hole 98 located along the length thereof and the shaft 96 of the dolly 16 is provided with suitable detent means 100 adjacent the forward end 102 of the shaft 96. The detent means 100 is urged outwardly by resilient means, such as spring 104, to engage the hole 98 to releasably retain the dolly 16 in engagement with the reel bearer 14. A hollow shaft 106 projects vertically upwardly from the axle 94 and a generally T-shaped handle member 108 is provided having a shaft portion 110 which is telescopically slideable within the hollow shaft 106 and a cross piece 112 which may be gripped by the electrician to facilitate movement of the reel bearer assembly 12. Openings 114 are provided in the hollow shaft 106, as seen at 114 and detent means, not shown, similar to detent 100, may be provided adjacent the lower end of the shaft portion 110 of the handle 108 to permit the shaft portion 110 of handle 108 to be releasably locked in a raised position to facilitate use of the handle 108 for moving the reel bearer assembly 12 and to permit the shaft portion 110 of the handle 108 to be telescoped into the hollow shaft 106 for storage when not in use. Preferably, the height of the channel member 28 of frame 26 will be such that, when the shaft 96 of the dolly 16 is mounted therein, the wheels 92 of the dolly 16 will be raised off the floor on which the base 18 of the reel bearer 14 is resting. This permits free pivoting of the frame 26 on the base 18 whether or not the dolly 16 is assembled therewith.

The dolly 16 is useful in moving the reel bearer 14 from one position to another within a given worksite. However, in moving from one worksite to another, it is often desireable to transport a plurality of reel bearer assemblies 12 together on a common cart. Frequently, a reel bearer manufacturer will also produce such carts. Unfortunately, there are no dimensional standards for reel bearer assemblies. Consequently, where reel bearers of several manufacturers are carried on a common cart, it is commonly found that some of the reel bearer assemblies do not fit properly in the cart but, instead, will tend to slide about as the cart is moved and may fall off of the cart and cause damage or injury to nearby persons or objects. To avoid this problem, the reel bearer 14 of the present invention provides a pair of hollow rods 116 mounted on opposite ends of the channel member 28 of frame 26 of the reel bearer 14, as best seen in FIGS. 1 and 2, and extending perpendicular to the channel member 28. One end 118 of each of the rods 116 is internally threaded and an elongated bolt 120 is threaded into the rod end 118. By threading the bolt 120 into or out of the rod 116, the lateral dimension of the reel bearer assembly 12 can be adjusted substantially as desired to adapt to the dimensions of a wide variety of carts. To secure the bolt 120 in a desired position, a lock washer 122 and nut 124 are provided on the bolt 120 which can be tightened against the adjacent end 118 of the rod 116 to prevent unwanted movement of the bolt 120. Similarly, at end 126 of the channel member 28 of frame 16 of the reel bearer 14, a bar 128 is slideable telescopically into and out of end 126 of the channel member 28 to permit adjustment of the length of the reel bearer assembly 12 and a screw 130 passes through an opening 132 in the channel member 28 to secure the bar 128 in a desired position. With these adjustments, it is possible to alter the dimensions of the reel bearer assembly 12 to prevent slippage of the reel bearer assembly 12 on substantially any carrying cart.

In use, the dimensions of the reel bearer assembly 12 are adjusted, as needed, to permit the reel bearer assembly 12 to be delivered to a worksite without fear of slippage. On arrival at the worksite, the reel bearer assembly 12 is off loaded from the cart and the handle 108 is extended to facilitate movement of the reel bearer assembly 12 to a desired work area by means of dolly 16. When the work area is reached, the reel bearer assembly 12 is rocked forward to allow the base 18 of the reel bearer 14 to rest on the floor As noted above, the height of the channel member 28 of the frame 26 of the reel bearer 14 is such that the wheels 94 of the dolly 16 will be off the floor when the reel bearer assembly 12 is resting on the base 18. Thereafter, the handle 108 may be retracted into shaft 106 and the reel bearer 14 may be used with the dolly 16 attached. Alternatively, detent 100 may be depressed to permit shaft 96 of the dolly 16 to be withdrawn from end 34 of the channel member 28 of frame 26 of the reel bearer 14 and the dolly 16 may be removed and stored or used separately from the reel bearer 14.

To mount a cable reel on the reel bearer 14, one of the end pieces 40 is removed from one of the crossarms 36 and the reel is slid onto the crossarm 36, forcing the resilient brake means 48 inwardly and the end piece 40 is repositioned to secure the cable reel on the crossarm 36. Where only one cable reel is to be mounted on the crossarm 36, the rotation plate 52 is preferably positioned between the cable reel and the end piece 40 to prevent binding of the cable reel against the end piece 40. However, where two or more cable reels are mounted on the crossarm 36, one of the rotation plates 52 is preferably interposed between each adjacent pair of cable reels. When this is done, the friction imposed by the resilient brake means 48 urging the assembly of reels and rotation plates toward the end piece 40 will prevent unwanted rotation of the reels and will prevent spillage, while the presence of the rotation plates 52 between adjacent cable reels will permit free rotation of each of the cable reels for withdrawal of cable therefrom.

With the reel bearer 14 resting on the base 18, with or without the dolly 16, the frame 26 may be rotated, as desired, about the pivot 30 to permit the electrician to orient the cable reels conveniently for withdrawal of cable from the reels carried by the reel bearer 14. Moreover, if the electrician desires to draw of several cables at one time, he may thread each of the cables through the cabling ring 86 and can adjust the orientation of the cabling ring 86 and cabling arm 80, as described above, to assure smooth and unhampered feeding of the entire group of cables from the cable reels carried by the reel bearer 14.

Obviously, numerous variations and modifications may be made to the reel bearer assembly of the present invention without departing from the spirit of the present invention. Therefore, it should be clearly understood that the form of the present invention described above and shown in the accompanying drawings is illustrative only and is not intended to limit the scope of the present invention.

I claim:

1. A cable reel bearer assembly comprising:

A base,

A frame rotatably mounted of said base and having an axis of rotation extending vertically upward from said base, said frame comprising a horizontal channel member pivotally mounted on said base, and an arcuate member secured to said channel member and extending vertically upward from said channel member, At least one crossarm mounted on said frame and extending perpendicularly outward from said frame, End pieces releaseably secured to the end of said crossarm and removable to permit cable reels to be mounted on said crossarm, Resilient brake means mounted on said frame and serving to urge cable reels mounted on said crossarm toward said end pieces.

2. The reel bearer assembly of claim 1 further 1 comprising:

A cabling arm mounted on said frame for selective vertical adjustment with respect to said frame, and A cabling ring mounted on the outer end of said cabling arm and rotationally adjustable with respect to said cabling arm.

3. The reel bearer assembly of claim 1 wherein:

Said resilient brake means is a helical spring twined said crossarm.

4. The reel bearer assembly of claim 1 further comprising:

Means carried by said frame for adjusting the lateral and longitudinal dimensions of said reel bearer assembly.

5. The cable reel bearer assembly of claim 1 further comprising:

A dolly comprising an axle,

A pair of wheels mounted at respective ends of said axle,

A handle extending upward from said axle, and

A shaft projecting forward from said axle and engageable with said frame to support said dolly on said frame with said wheels off the floor and serving, when said dolly is rocked onto said wheels, to support said base and said frame for movement by said dolly.

6. The reel bearer assembly of claim 5 wherein:

The handle of said dolly comprises:

A hollow shaft extending upward from said axle,

A generally T-shaped handle portion having a shaft portion telescopically slideable into and out of said hollow shaft, and Means for securing the shaft portion of said handle at a desired vertical position within said hollow shaft.

7. A cable reel bearer assembly comprising:

a base;

a frame rotatably mounted on said base and extending vertically upward from said base, said frame comprising:

a horizontal channel member pivotally mounted on said base, and an arcuate member secured to said channel member and extending vertically upward from said channel member;

at least one crossarm mounted on said frame and extending perpendicularly outward from said frame;

end pieces releasably secured to the end of said crossarm and removable to permit cable reels to be mounted on said crossarm;

a dolly comprising an axle, a pair of wheels mounted at respective ends of said axle, a handle extending upward from said axle, a shaft projecting forward from said axle and engageable with said frame to support said dolly on said frame with said wheels off the floor and serving when said dolly is supported by said wheels to support said frame for movement by said dolly;

said channel member (is) being hollow and (the) said shaft of said dolly (is) being releasably engageable within said channel member.

8. The reel bearer assembly of claim 7 further comprising:

a rotation plate slideably mounted on said crossarm, said rotation plate comprising:

a pair of side plates each formed with a central boss and having an axial bore extending through said boss to receive said crossarm and an annular bearing raceway concentric with said bore, a plurality of ball bearings mounted in said raceway, and bushing means extending through said bores to secure said side plates together.

9. (The reel bearer assembly of claim 1 further) A cable reel bearer assembly comprising:

a base, a frame rotatably mounted on said base and extending vertically upward from said base, at least one crossarm mounted on said frame and extending perpendicularly outward from said frame, end pieces releasably secured to the end of said crossarm and removable to permit cable reels to be mounted on said crossarm, resilient brake means mounted on said frame and serving to urge cable reels mounted on said crossarm toward said end pieces, a rotation plate slideably mounted on said crossarm, said rotation plate comprising:

a pair of side plates each formed with a central boss and having an axial bore extending through said boss to receive said crossarm and an annular bearing raceway concentric with said bore, a plurality of ball bearings mounted in said raceway, and bushing means extending through said bores to secure said side plates together.

10. A reel bearer assembly comprising:

a base, a horizontal channel member pivotally mounted on said base with the axis of said pivot extending vertically, and means for securing a reel bearer onto said channel member said securing means including an arcuate member extending vertically from said channel member having means for rotatably supporting at least one reel.

11. The reel bearer assembly of claim 10 further comprising:

a dolly comprising:

an axle, a pair of wheels mounted at respective ends of said axle, a handle extending upward from said axle, and a shaft projecting forward from said axle and engageable with said base to support said dolly on said base with said wheels off the floor and serving when said dolly is supported by said wheels to support said base for movement by said dolly.

* * * * *